US012263925B1

(12) United States Patent
Link

(10) Patent No.: US 12,263,925 B1
(45) Date of Patent: Apr. 1, 2025

(54) AUTOMATIC FLOATING DOCK ADJUSTER

(71) Applicant: Stanley C. C. Link, Crystal City, MO (US)

(72) Inventor: Stanley C. C. Link, Crystal City, MO (US)

( * ) Notice: Subject to any disclaimer, the term of this patent is extended or adjusted under 35 U.S.C. 154(b) by 567 days.

(21) Appl. No.: 17/749,344

(22) Filed: May 20, 2022

(51) Int. Cl.

| | |
|---|---|
| ***B63C 1/02*** | (2006.01) |
| ***B63B 21/00*** | (2006.01) |
| ***B63B 21/16*** | (2006.01) |
| ***B63B 21/50*** | (2006.01) |
| ***E02B 3/06*** | (2006.01) |

(52) U.S. Cl.
CPC ..... *B63C 1/02* (2013.01); *B63B 21/16* (2013.01); *B63B 21/50* (2013.01); *E02B 3/064* (2013.01); *B63B 2021/003* (2013.01)

(58) Field of Classification Search
CPC ... B63B 21/00; B63B 2021/003; B63B 21/16; B63B 21/50; B63C 1/00; B63C 1/02; B63C 1/04; B63C 1/06; B63C 1/08; B63C 1/10; B63C 3/00; E02B 3/064; B66D 1/08; B66D 1/48; B66D 1/50; B66D 2700/0108
USPC .... 114/230.21, 230.22, 230.23, 230.24, 263; 405/218–221
See application file for complete search history.

(56) References Cited

U.S. PATENT DOCUMENTS

| | | | | |
|---|---|---|---|---|
| 1,527,555 | A | 2/1925 | Johnson | |
| 1,848,972 | A | 3/1932 | Peebles | |
| 3,608,864 | A | 9/1971 | Dargitz et al. | |
| 4,740,108 | A * | 4/1988 | Levee | E02B 3/068 405/196 |
| 5,944,451 | A | 8/1999 | Martin et al. | |
| 6,295,944 | B1 * | 10/2001 | Lovett | E02B 3/064 114/263 |
| 8,336,478 | B2 * | 12/2012 | Craft | B63B 27/143 114/263 |
| 9,233,735 | B2 | 1/2016 | Ramey et al. | |
| 10,081,520 | B2 | 9/2018 | Smith et al. | |
| 10,427,921 | B2 | 10/2019 | Codd et al. | |

FOREIGN PATENT DOCUMENTS

| | | |
|---|---|---|
| DE | 1170126 B1 | 5/1964 |
| WO | 2021126071 A1 | 6/2021 |

* cited by examiner

*Primary Examiner* — Ajay Vasudeva
(74) *Attorney, Agent, or Firm* — Grace J. Fishel

(57) ABSTRACT

An automatic floating dock adjuster for a floating dock attached at a shoreline side with shore cables. The adjuster having a spool mounted at a first end of a support frame and a tension frame pivoted on the support frame between the spool and the second end of the frame. An anchor cable wound on the spool, passing over and around a roller on the tension frame, under the spool and attached to an anchor in the water at the rear of the dock. A tension cable attached to the tension frame and to a counterweight under the floating dock. A hydraulic pump operated in response to movement of the tension frame for operating a hydraulic motor to rotate the spool to pay out or haul in the anchor cable.

10 Claims, 11 Drawing Sheets

AUTOMATIC FLOATING DOCK ADJUSTER

BACKGROUND OF THE INVENTION

Field of the Invention

The present invention relates to an automatic floating dock adjuster for an anchor cable that does not require a user to get on the dock to make the adjustment necessitated by changes in the water level.

Brief Description of the Prior Art

It is a common necessity of floating dock owners and property caretakers of lake front property to periodically relocate the dock in relation to the shoreline because of changes in the water level. Floating docks are typically held in place by means of shore cables attached to the shore side of the dock and an anchor cable attached to the rear of the dock.

The shore cables are attached to winches located above the high water level or to remote controlled winches on the floating dock. When the water drops, the shoreline moves out and shore cable must be let out to keep the floating dock from beaching. The anchor cable, which is an absolute necessary as a guard against wave and boat wakes, also needs adjusting as it becomes slack. If the water rises, the shoreline moves inward and the anchor cable needs to be let out otherwise it may pull down the back of the float.

Adjusting the shore cable can be done from the shore. Adjusting the anchor cable must be done from the floating dock. Hence with rising or falling water levels, the owner or caretaker must get onto the dock. This may require some wading, swimming or paddling, pleasant enough in warm weather but dangerous in the winter.

BRIEF SUMMARY OF THE INVENTION

In view of the above, an object of the present invention is to provide an automatic floating dock adjuster for an anchor cable.

The subject automatic floating dock adjuster is adapted for use with a floating dock attached at a shoreline side with shore cables. The adjuster has a spool mounted at a first end of a support frame and a tension frame pivoted on the support frame between the spool and the second end of the frame. An anchor cable is wound on the spool, passing over and around a roller on the tension frame, under the spool and attached to an anchor in the water at the rear of the dock. A tension cable is attached to the tension frame and to a counterweight under the floating dock. A hydraulic pump operated in response to movement of the tension frame causes a hydraulic motor to rotate the spool to pay out or haul in the anchor cable as needed.

In an embodiment, the support frame is built on first and second longitudinal supports to which first and second sets of switches are attached. When the water level rises and the tension frame pivots towards the spool, the first set of switches causes the hydraulic motor to rotate the spool towards the second end of the frame paying out the anchor cable. When the water level drops and the tension frame pivots away from the spool, the second set of switches causes the hydraulic motor to rotate the spool towards the first end of the frame hauling out the anchor cable.

BRIEF DESCRIPTION OF THE SEVERAL VIEWS OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF AT LEAST ONE PREFERRED EMBODIMENT OF THE INVENTION

Figure 11:
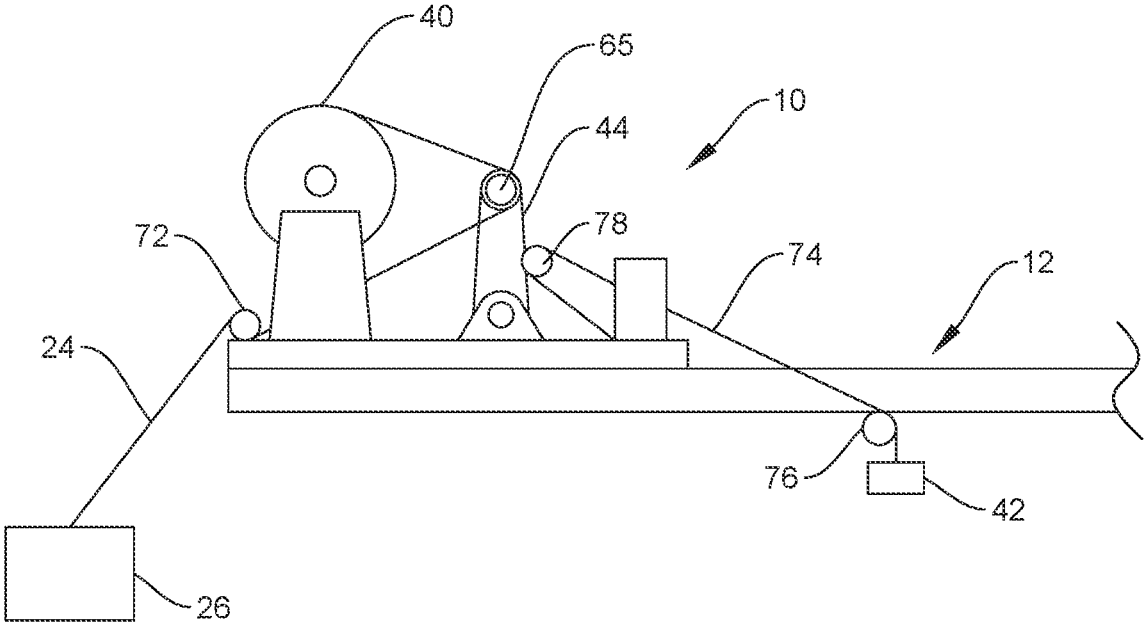

Referring to the drawings more particularly by reference character, a floating dock adjuster 10 is used with a floating dock 12 held in place in relation to a shoreline 14 by means of shore cables 16 and shore anchor points 18 as seen in FIG. 11. There are two anchor cable assemblies 20 on the dock, one on each dock corner closest to the shore, attached to shore cables 16. The shore anchor points 18 are positioned above the high water level. Hand operated winches 22 are positioned at the shore anchor points and are attached to shore cables 16. Winches 22 are used to control the length of shore cables 16, thereby controlling the distance from the shore. In addition to the shore cables, floating dock has an anchor cable 22 at the end of the dock attached to an anchor 26 in water.

Floating dock adjuster 10 is build on a support frame 28 with first and second ends 30, 32, respectively, attached to a flat surface on the end of dock 12 facing outward. Frame 28 includes first and second longitudinal members 34, 36, respectively, with transverse members 38 extending between and connecting the longitudinal members, which are illustrated as L-shaped rods. A spool 40 is mounted at first end 30, a counterweight 42 is attached at the second end 32 with a tension frame 44 between said ends as shown in FIG. 12.

First and second support plates 46, 48 are bolted or otherwise attached to an outboard side of longitudinal members 34, 36, respectively, at first end 30 of frame 28. A drum 50 is mounted between first and second support plates 46, 48 on an axle 52 supported by pillow block bearings 54 on first and second support plates with spacer blocks 56. Drum 50 is flanked on both ends by flange members 58 fixedly attached to the drum 50 forming spool 40 about which anchor cable 24 is wound.

Tension frame 44 is formed by first and second pivot arms 60, 62 pivoted on first and second longitudinal members 34, 36, respectively, between first and second ends 330, 32 of frame 28. A roller 64 is positioned between an upper end of pivot arms 60, 62 with a shaft 66 at the lower ends. Shaft 66 supported in pillow blocks 54 on mounting platform 68 of overlapped rods. Pivot arms 60, 62 are joined together with a cross member 70 thus completing tension frame 44.

A first end of anchor cable 24 is attached to one of flanges 58 and wound on drum 50. Anchor cable 24 passes over and around roller 65 on tension frame 44, then under spool 40 and over a roller 72 on the first end 30 of the support frame. Roller 65 on tension frame allows anchor cable 24 to move translationally across the roller such the cable may be wound neatly on drum 50 in a series of layers. Second roller 72 on first end 32 of the support frame reduces wear on the cable. A second end of anchor cable 24 is attached to anchor 26 in the water. In the form shown in the drawings, drum 50 holds 300 feet of stainless steel cable and is connected to a 2000 lb anchor in the lake bottom.

Counterweight 42 is attached to cross member 70 of tension frame 44 to counter balance the pull of anchor cable 24 on roller 65. As shown, counterweight 42 is attached with a tension cable 74 passing out second end 32 of the support frame and through the dock. One end of tension cable 74 is attached to the weight, passes over a pulley 76 attached to an underside of the dock, over a second pulley 78 attached to cross member 70 and is secured at an opposite end to transverse member 38 of the support frame. In the form illustrated, counterweight 42 weights 300 lbs. The pull on tension frame 44 by tension cable 74 may be increased as needed to balance the system by either increasing the weight of counterweight 42 or by using a compound pulley. The term "cable" in connection with anchor cable 24 and tension cable 74 may be a wire, chain, rope or any other suitable material such that the term "cable" as used in the present disclosure is inclusive of all such materials.

Figure 1:
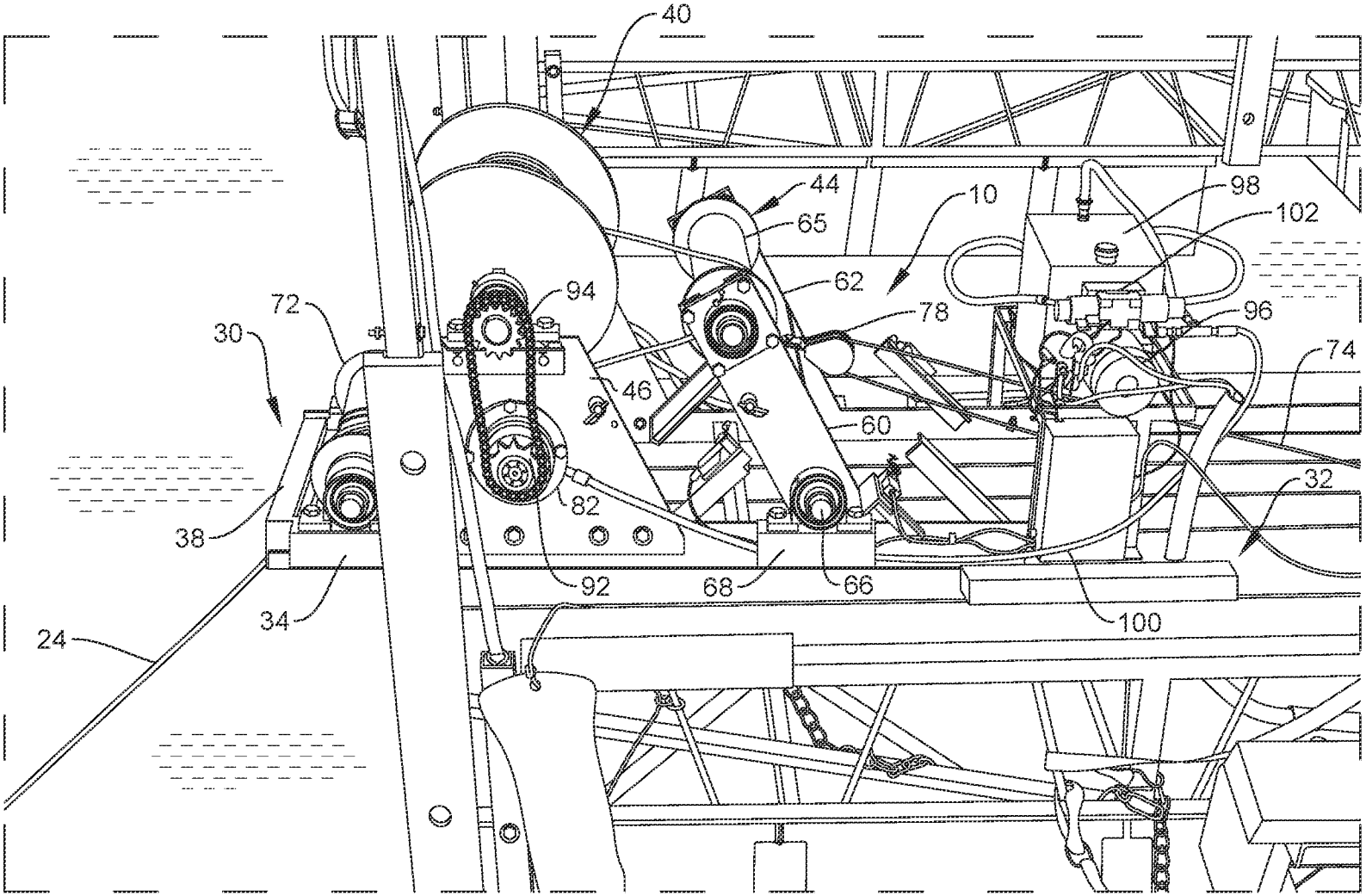
FIG. 1 is a left side view of an automatic floating dock adjuster in accordance with the present invention.
Figure 2:
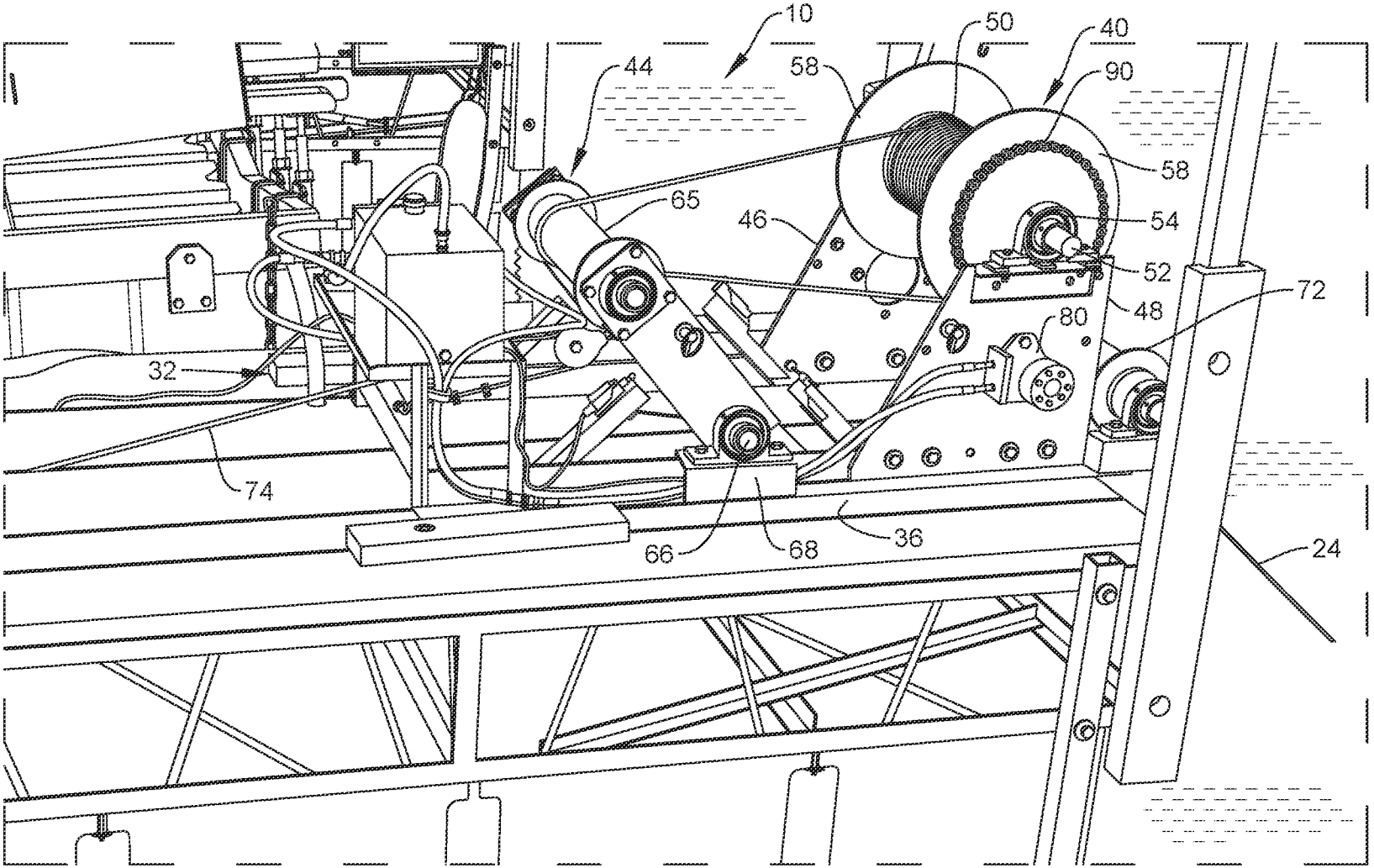
FIG. 2 is right side view thereof.
Figure 3:
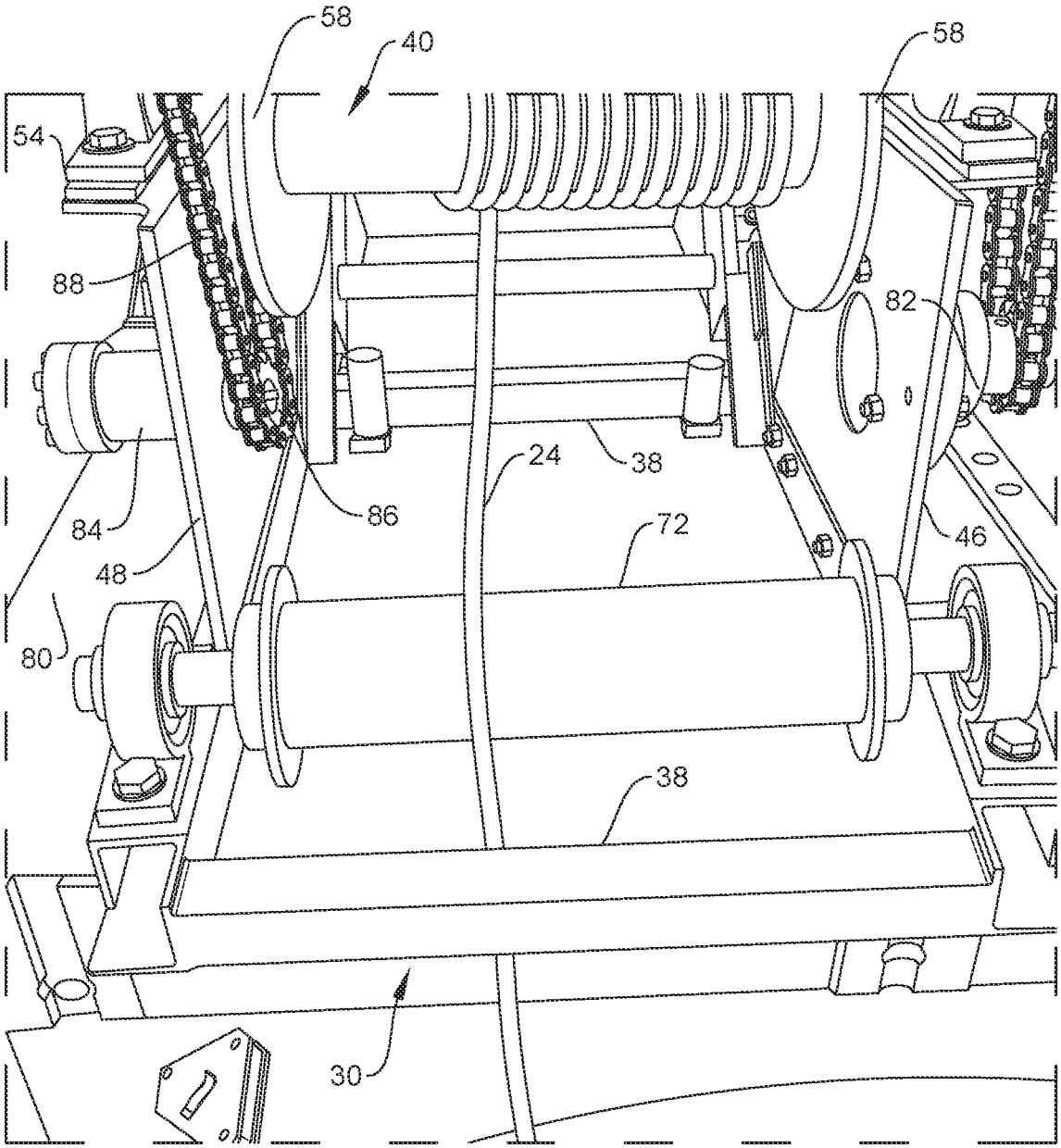
FIG. 3 is front view thereof.
Figure 4:
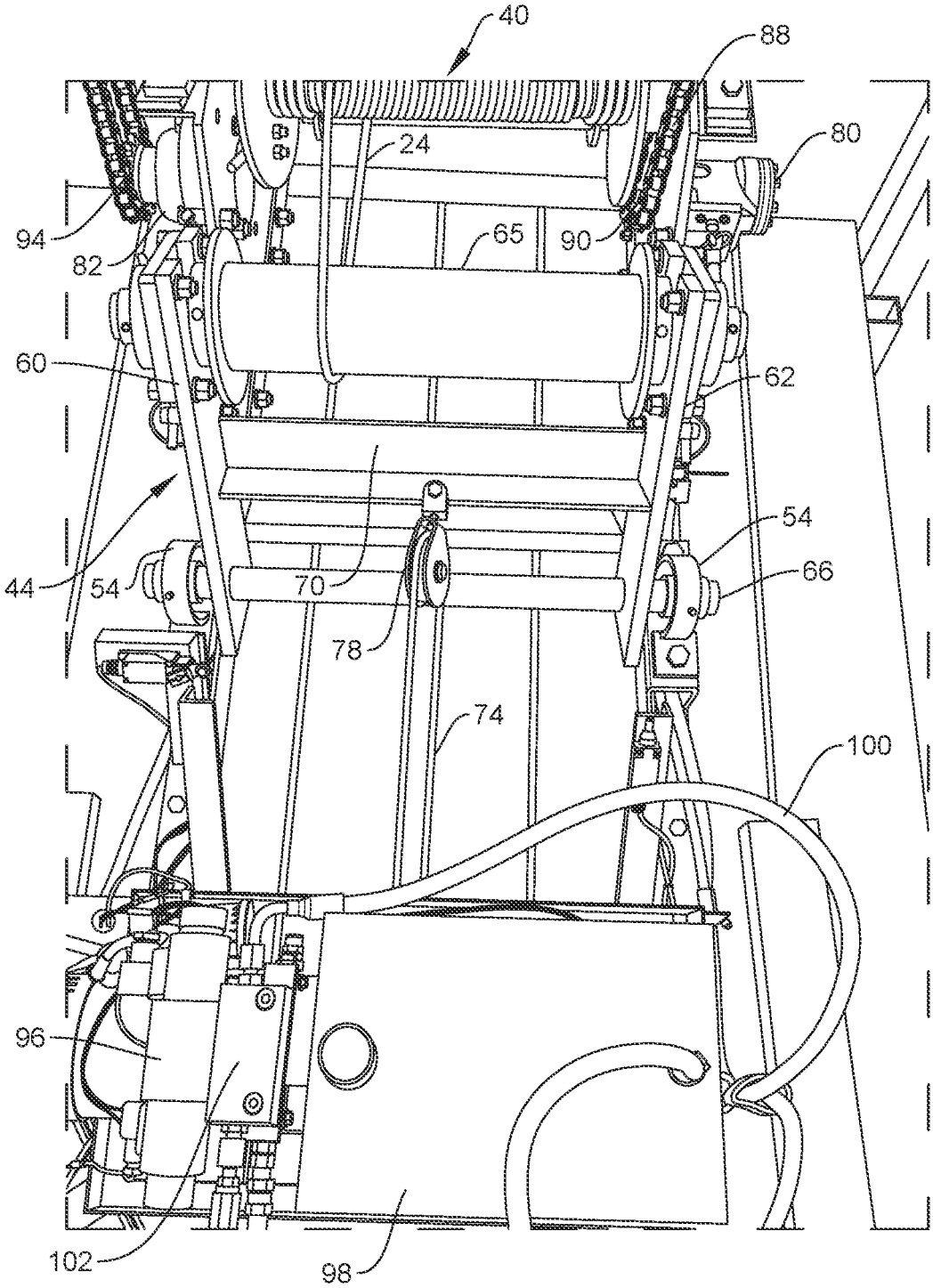
FIG. 4 is a rear perspective view viewed from above.
Figure 5:
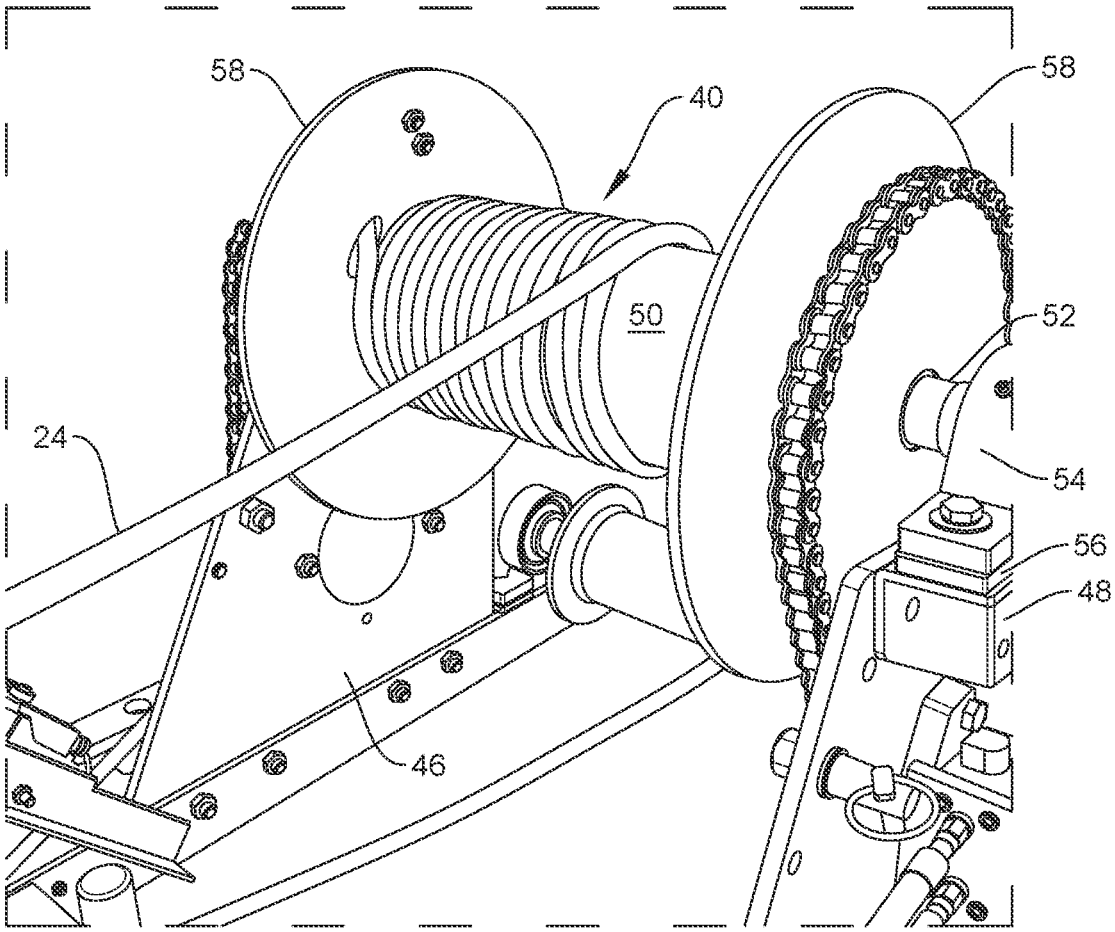
FIG. 5 is a detail viewed from the right side showing a hydraulic motor.
Figure 6:
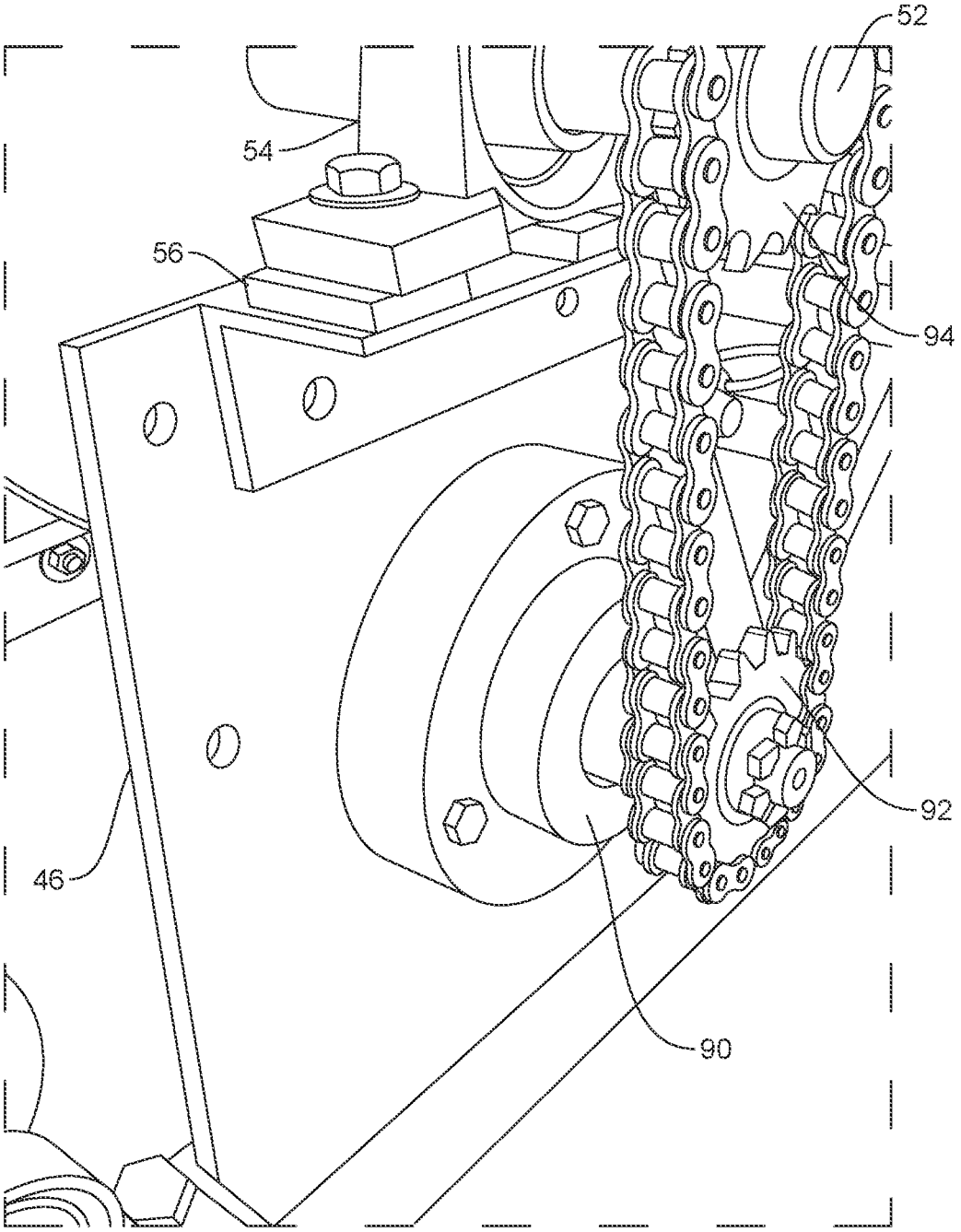
FIG. 6 is a detail viewed from the left side showing a hydraulic brake.
Figure 7:
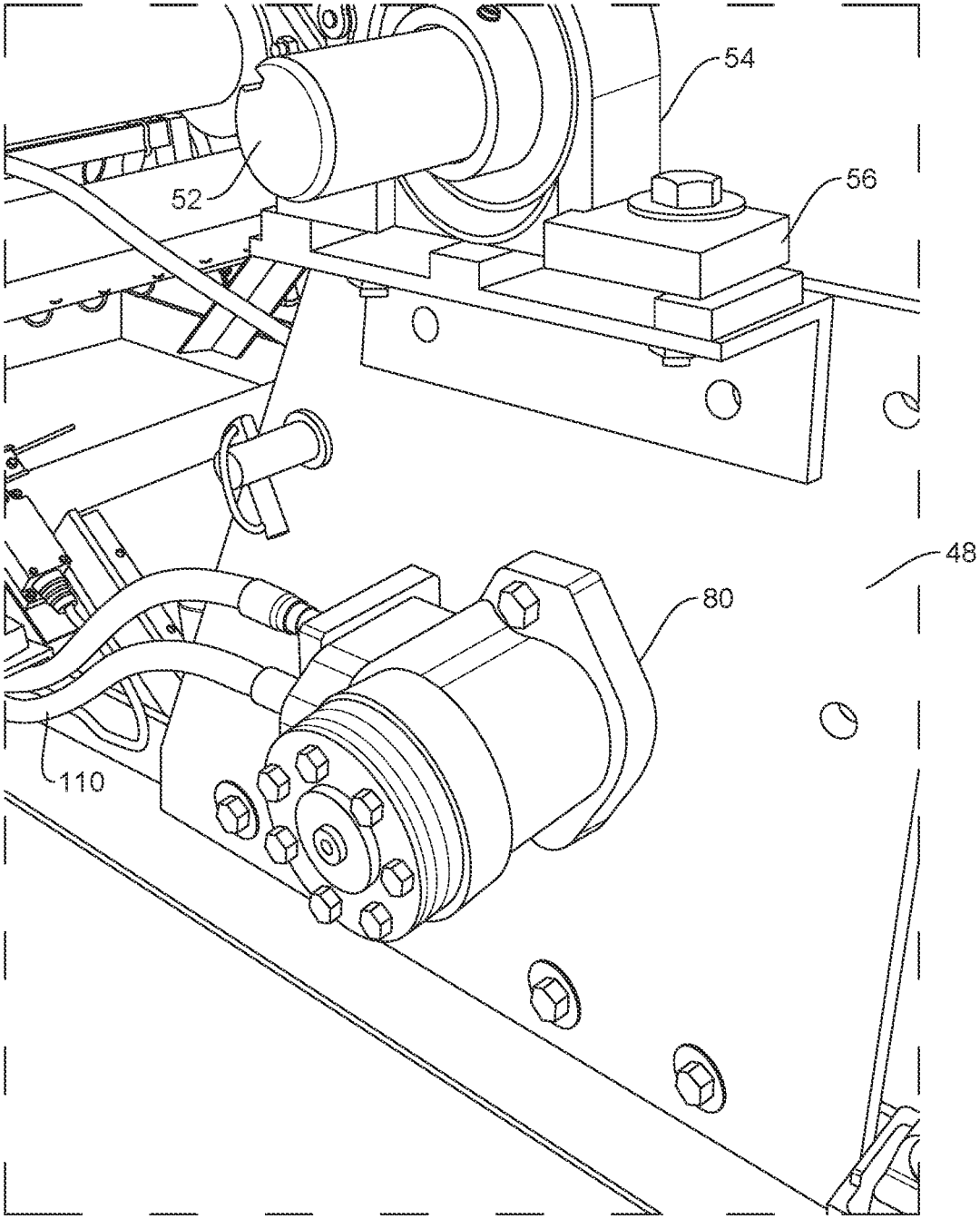
FIG. 7 is a detail viewed from the right side showing the hydraulic motor.

A hydraulic motor 80 for rotating spool 40 in a forward (hauling in direction) or a backward (paying out direction) is attached to one end of drum axle 52. A hydraulic brake 82 may be attached to the opposite end of axle. As best seen in FIGS. 3, 5 and 7, hydraulic motor 80 is attached to the outside of second support plate 48 with its output shaft 84 connected to a drive sprocket 86. A roller chain 88 connects the drive sprocket 86 with driven sprocket 90 attached to drum flange 58. In similar manner a drive sprocket 92 on the output shaft of hydraulic brake 82 is connected to a driven sprocket 94 attached to the other drum flange 58.

An electric hydraulic pump 96 with a fluid reservoir 98 is positioned on second end 32 of the support frame. Pump 96 is powered by a battery which may be charged with solar panels attached to dock, details of which are omitted from the drawings so as not to obscure the present disclosure. Hydraulic lines 100 connect hydraulic motor 80 and hydraulic brake 82 with pump 96. A solenoid controlled valve 102 reverses the direction of flow through hydraulic lines 100 such that spool 40 may be rotated in a forward or backward direction by hydraulic motor 80. When hydraulic pump 96 is not operating, pressure in hydraulic lines 100 may fall and the pulling pressure of anchor cable 24 may cause spool 40 to rotate. To prevent that, when pressure is released on hydraulic lines 100, hydraulic brake 82 locks drive sprocket 92 and prevents rotation of drum 50. Hydraulic brake 82 is released when hydraulic pump 96 starts and puts pressure back on hydraulic lines 100.

Figure 8:
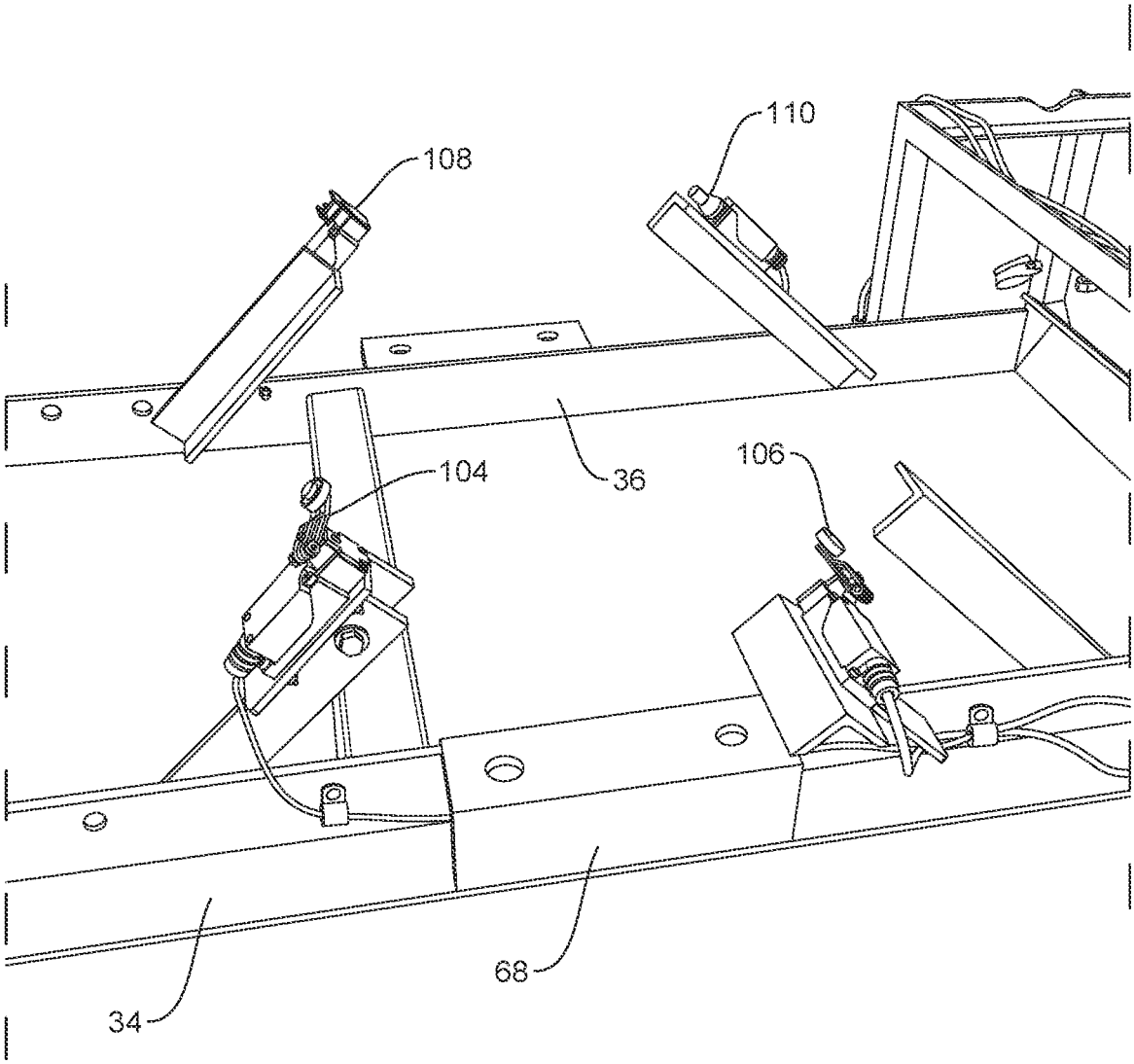
FIG. 8 is perspective view of a first and second set of switches for use with a tension frame as shown in other figures.
Figure 9:
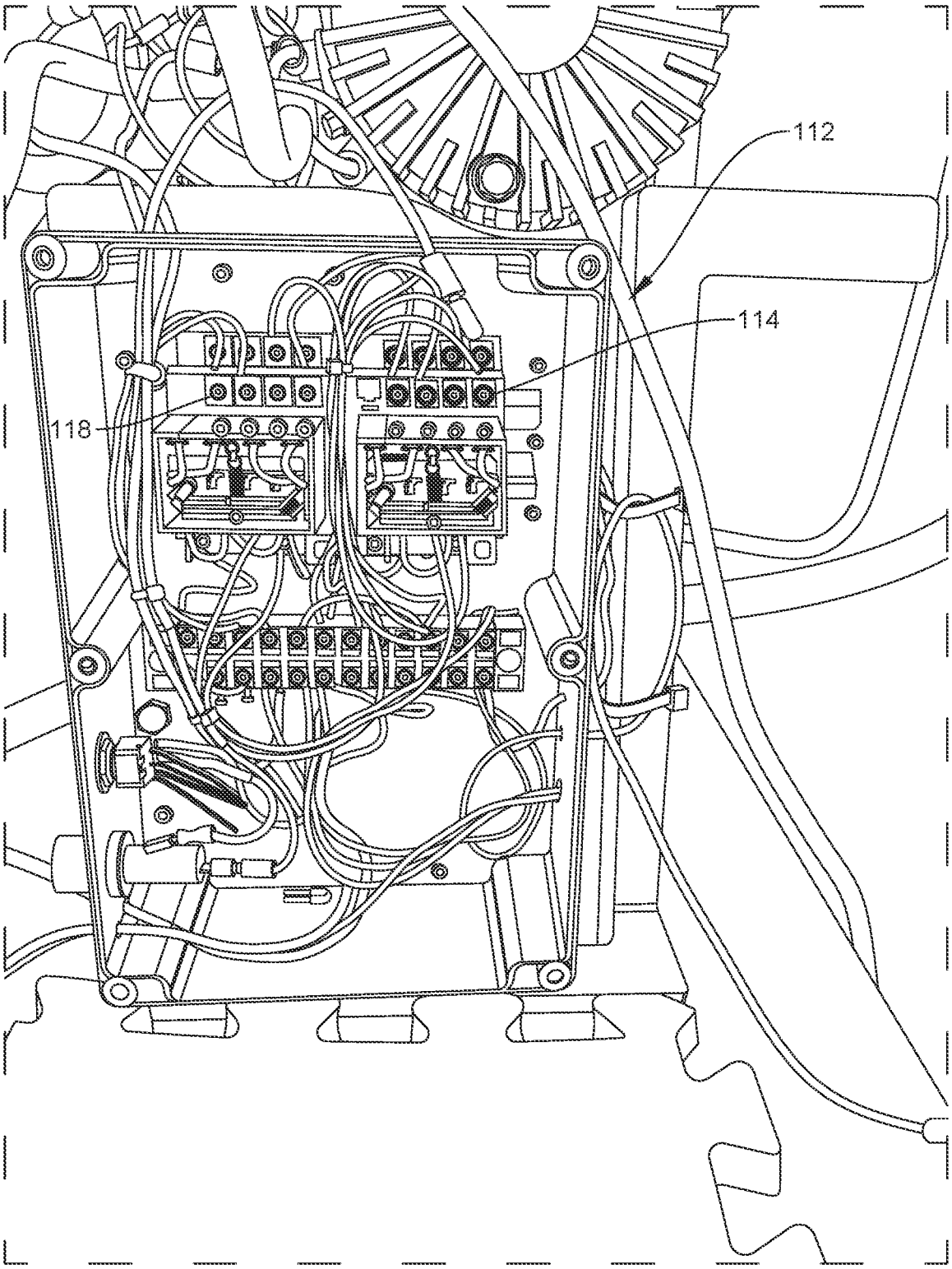
FIG. 9 is a side elevation of a control board.
Figure 10:
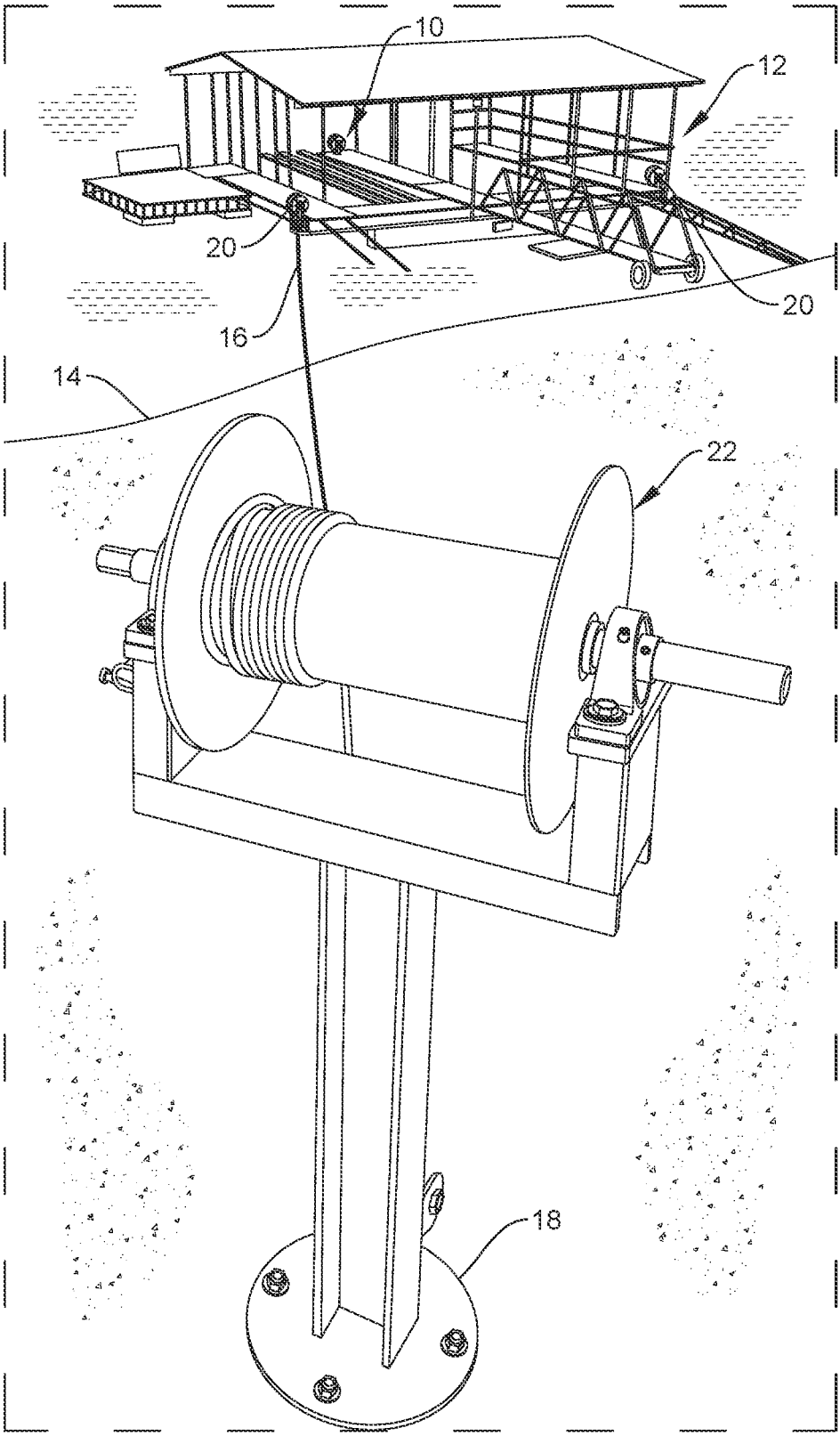
FIG. 10 is perspective view of a floating dock attached to shore cables; and, FIG. 11 is a concept drawing showing floating dock adjuster.

Two sets of switches 104, 106 and 108, 110 best seen in FIG. 8 are positioned between spool 40 and tension frame 44 to monitor movement of the tension frame with a control board 112 seen in FIG. 9. Control board 112 governs hydraulic pump 96 and the rotation of spool 40 to adjust for changes in the water level.

In use, when the water level in the body of water goes up, tension on anchor cable 24 increases and pulls tension frame 44 towards spool 40. When first pivot arm 60 contacts switch 104 a signal is sent to control board 112. Control board 112 starts hydraulic pump 96 pressuring hydraulic lines 100 which releases hydraulic brake 82. Through solenoid controlled valve 102 pump 96 causes hydraulic motor 80 to rotate spool 40 in the payout direction. As anchor cable 24 is paid out tension frame 44 pivots rearwardly. When pivot arm 60 contacts switch 106 a signal is sent to control board 112 causing the hydraulic pump to stop, the hydraulic brake to lock and switches 104 and 106 to be reset through relays 114.

On the other hand, if the water level falls, tension on anchor cable 24 is released and tension frame 44 rotates away from spool 40. When the water level has fallen sufficiently that second pivot arm 62 contacts switch 110 (which occurs before first pivot arm 60 contacts switch 106) a signal is sent to control board 112 causing hydraulic pump 96 to start pumping in the reverse direction through solenoid controlled valve 203 while hydraulic brake 82 is released. As anchor cable 24 is hauled in on spool 40, tension frame 44 pivots towards spool 40. When second pivot arm 62 contacts switch 108 a signal is sent to control board 112 causing the hydraulic pump to stop and switches 108 and 110 to be reset through relays 116.

Smaller amounts of water level change from wave action or boat wakes are accommodated without contacting either set of switches 104, 106 or 108, 110 and starting hydraulic pump 96. In the embodiment illustrated in the drawings, about 15 inches of anchor cable 24 may be pulled in or out by movement of the dock on the water without activating the system. While during all times, the pull on tension cable 74 is remains constant. It will be understood that the weight of the anchor, the weight of the counterweight and the length of the anchor cable wound the drum mentioned above and the amount of play in the anchor cable before triggering the hydraulic pump is illustrative and not limiting.

In view of the above, it will be seen that the object of the invention is achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An automatic floating dock adjuster comprising a support frame with first and second ends, said frame including first and second longitudinal members with transverse members extending between and connecting the longitudinal members, said frame configured for attachment to a rear of a floating dock attached at a shoreline side with shore cables, a spool mounted at the first end of the frame, said spool rotated by a hydraulic motor powered by a hydraulic pump, a tension frame formed by first and second pivot arms pivoted on the first and second longitudinal members and positioned between the spool and the second end of the frame, an anchor cable wound on the spool, passing over and around the tension frame, under the spool and attached to an anchor at the rear of the dock, a tension cable attached to the tension frame and to a counterweight under the floating dock, said hydraulic pump operated in response to movement of the tension frame.

2. The floating dock adjuster of claim 1 wherein a roller is positioned between an upper end of the first and second pivot arms, said first and second pivot arms joined by a cross member below the roller.

3. The floating dock adjuster of claim 2 wherein first and second switches flank the tension frame and are attached to the first longitudinal member and third and fourth switches flank the tension frame and are attached to the second longitudinal member, said first pivot arm and the first and second switches causing said spool to pay out the anchor cable and said second pivot arm and the third and fourth switches causing said spool to haul in the anchor cable.

4. The floating dock adjuster of claim 3 wherein a first pulley is attached to an underside of the dock and a second pulley is attached to the cross member of the tension frame, a first end of the tension cable connected to the counterweight and a second end connected to a second end of the support frame and passing around the first pulley and the second pulley.

5. An automatic floating dock adjuster comprising a support frame with first and second ends, said frame including first and second longitudinal members with transverse members extending between and connecting the longitudinal members, said frame configured for attachment to a rear of a floating dock attached at a shoreline side with shore cables, a spool mounted at the first end of the frame on first and second support plates attached to the first and second longitudinal members, said spool comprising a drum mounted on an axle, a hydraulic motor powered by a hydraulic pump is connected to a first end of the axle and a hydraulic brake is connected to a second end of the axle, a tension frame formed by first and second pivot arms pivoted on the first and second longitudinal members and positioned between the spool and the second end of the frame, a roller positioned between an upper end of the first and second pivot arms and a cross member below the roller connecting the first and second pivot arms, an anchor cable wound on the spool, passing over and around the roller on the tension frame, under the spool and attached to an anchor at the rear of the dock, a tension cable attached to the cross member of the tension frame and to a counterweight under the floating dock, said hydraulic pump operated in response to movement of the tension frame.

6. The floating dock adjuster of claim 5 wherein first and second switches flank the tension frame and are attached to the first longitudinal member and third and fourth switches flank the tension frame and are attached to the second longitudinal member, said first pivot arm and the first and second switches causing said spool to pay out the anchor cable and said second pivot arm and the third and fourth switches causing said spool to haul in the anchor cable.

7. The floating dock adjuster of claim 6 wherein the first switch is contacted before the third switch as the tension arm pivots towards the spool and wherein the fourth switch is contacted before the second switch as the tension arm pivots away from the spool.

8. The floating dock adjuster of claim 7 wherein hydraulic lines connect the hydraulic motor and the hydraulic brake to the pump and wherein signals from said first and second switches and said third and fourth switches are connected through relays to a control board, said control board operating a valve that controls the direction of flow through the hydraulic line.

9. The floating dock adjuster of claim 5 wherein a first pulley is attached to an underside of the dock and a second pulley is attached to the cross member of the tension frame, a first end of the tension cable connected to the counterweight and a second end of the tension cable connected to a second end of the support frame, said tension cable passing around the first pulley and the second pulley.

10. The floating dock adjuster of claim 5 wherein the hydraulic pump is a battery operated electric hydraulic pump, said battery charged by solar cells on the dock.

* * * * *